US005138817A

United States Patent [19]

Mowry et al.

[11] Patent Number: 5,138,817

[45] Date of Patent: Aug. 18, 1992

[54] METHOD OF AND SYSTEM FOR CREATING A UNIFORM LOG OF STRAPPED BUNDLES

[75] Inventors: Harry E. Mowry, Naples, Fla.; David F. Hall, Plattsburgh, N.Y.; John E. Prim, West Chazy, N.Y.; Robert D. Kinson, Plattsburgh, N.Y.

[73] Assignee: Prim Hall Enterprises, Inc., Plattsburgh, N.Y.

[21] Appl. No.: 678,055

[22] Filed: Apr. 1, 1991

[51] Int. Cl.[5] ..... B65B 27/08; B65B 5/06; B65B 5/08; B65B 13/18

[52] U.S. Cl. ..... 53/399; 53/445; 53/446; 53/447; 53/155; 53/504; 53/541; 53/586; 414/789.5

[58] Field of Search ..... 53/445, 446, 447, 448, 53/148, 155, 157, 504, 505, 540, 541, 542, 544, 399, 586; 198/406, 407, 412, 431, 437; 414/799, 788.5, 789.3, 789.5

[56] References Cited

U.S. PATENT DOCUMENTS

| | | | |
|---|---|---|---|
| 2,699,264 | 1/1955 | Bruce et al. | 53/448 X |
| 3,495,374 | 2/1970 | Ebbers et al. | 53/447 X |
| 3,700,127 | 10/1972 | Kurk et al. | 53/446 X |
| 3,890,764 | 6/1975 | Hartman | 53/541 X |
| 4,249,847 | 2/1981 | Tokuno | 198/407 X |
| 4,439,097 | 3/1984 | Mebus | 414/789.5 |
| 4,590,743 | 5/1986 | Hardage | 53/446 |
| 4,718,538 | 1/1988 | Löw et al. | 198/431 X |
| 5,010,715 | 4/1991 | Fluck | 53/447 |

*Primary Examiner*—Horace M. Culver
*Attorney, Agent, or Firm*—Louis Weinstein

[57] ABSTRACT

The system comprises at least one conveyor for carrying the bundles with equipment for checking bundle integrity and verifying correct addresses. Equipment can be included to remove unacceptable bundles and to divert each bundle to the predetermined conveyor and align the bundles properly. The bundles are rotated and held in position until a uniformed, and/or predetermined dimension log is achieved and then moved into position for strapping the log, identifying it and attaching the label. Conveyors are used to place each log in position to be palletized in conjunction with other logs. The logs can be rotated to create cross stacking of the logs and equipment can be used to raise or lower each layer of the logs. When the complete pallet is created an address and information label is prepared and attached. The method comprises the control of a number of pieces of equipment by means of a programmable system control designed to maintain the sequential integrity of the output, that is the preparation of bundles of variable height into logs of uniform width, height and predetermined length into palletized loads onto which the sequentially produced logs produce a pallet on which the sequence of the logs is maintained. Pallet content, configuration and sequence is captured as printed and electronic records are prepared for internal and external use and reprocessing.

20 Claims, 3 Drawing Sheets

*Fig. 4*
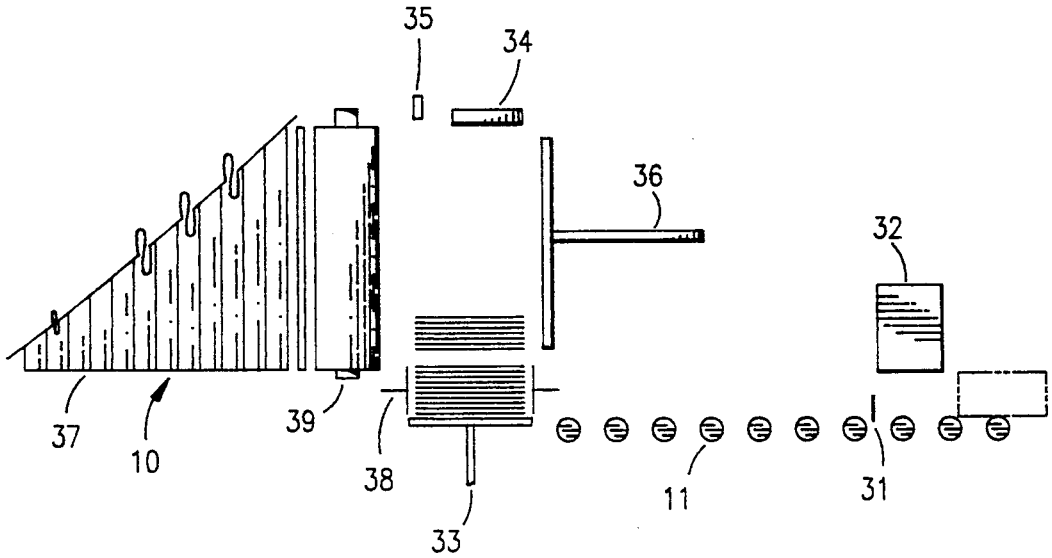
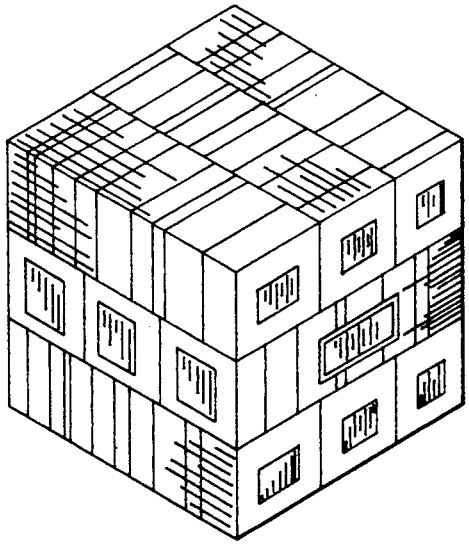
*Fig. 5*

METHOD OF AND SYSTEM FOR CREATING A UNIFORM LOG OF STRAPPED BUNDLES

This invention pertains to the reorientation of variable height bundles by placing the variable dimensions end to end with the constant width and breadth dimensions of multiple bundles logs of a predetermined length. By this method, the sequential integrity of production of addressed and identifiable materials, such as publications, and the like, can be maintained.

There are many strapping systems currently being used that are being used for a number of different applications. There are a number of systems that create pallets from bundles currently in use. The U.S. Pat. No. 4,014,784 issued to C. Dunlap, for a Sorting Apparatus, #4,014,784 shows a device that sorts bundles by zip code is an example of that type device. Another example is the U.S. Pat. No. 2,699,264 to J. Bruce for A Pallet Loader. There are a number of limitations with the apparatus taught by these and similar references. They do not prepare the bundles sequentially and produce logs which may be placed on a pallet. They just break up the identified sequence of stacked bundles because zip code groupings are of unequal quantities which cause variable height bundles. What has not been shown and needs to be taught is a method and system that will maintain and preserve the sequence of the production. It would also improve the current knowledge to automate the skid loading, when variable height units are involved, breakdown and the distribution of publications and such while identifying the contents of each log and maintain the visibility of that identity on the logs and pallet. Another advantage would be to stabilize the pallet by means of uniform logs within certain predetermined tolerances and interlocking layers of logs. It would also reduce damage to the contents because of strapping the uniform logs rather than the random stacking or sacking of loose bundles because of the variable height of individual bundles.

It is the object of this invention, then to set forth an improved method of and system for creating a uniform log of variable height strapped bundles, which avoids the cited disadvantages of other sequentially sensitive products, mail publications and such, handling and loading systems It is also the object of this invention to teach a system which will preserve the accurate sequential relationship of the uneven stacks at the end of the production line and maintain the identification of the sequential system. It is another object of this invention to eliminate the manual stacking by means of automating the pallet loading, while at the same time, stabilizing the pallet loads and give a sequential content listing and electronic record of the entire pallet. Finally, it is another object of this invention to teach a system which will simplify and automate the breakdown process at the destination of the publication or other product. Particularly, it is the object of this invention to set forth a method of creating a log of uniform width and breadth, and of predetermined length from a multiple number of strapped bundles, which contain a variable number of sequentially collected items, which cause the bundles to be of variable height, thereby capturing and maintaining the sequential integrity physically in strapped logs which are sequentially arranged on a skid or pallet, with log and pallet contents recorded on a log the log and pallet, as well as electronic memory, for accurate distributions and potential automation of loading and depalletizing in sequential order as required, comprising the steps of determining the height of each variable content bundle as it is conveyed and strapped or wrapped as a distinct unit determined by factors such as zip or carrier route sorted material; moving bundles in sequence by conveyor to the control point where they may be rejected or allowed to continue by conveyor to a point of directional control; rotating bundles to place the variable dimension of the former top of the bundle toward the former bottom of the preceding bundle thereby maintaining the sequence of units from last in the preceding bundles next to the top or first unit of the following bundle, thereby maintaining unit to unit and bundle to bundle sequential integrity; determining by means of predetermined tolerances on the log length when the correct combination of bundles have combined to make a finished log or when a distribution/delineation break has been reached; strapping or wrapping the log unit; moving the log unit by programmed conveyor to a predetermined skid or pallet load position; printing and applying a contents label to the log unit; cross rotating the log unit to provide locking security and stability to the skid or pallet; predetermining the skid/pallet load; labelling the skid/pallet with content information for distribution and load breakdown automation; and monitoring and recording sequential integrity by means of programmable controller or computer units, so that any bundle rejection is documented on the labels of the logs and skids along with reorder or replacement information.

It is also an object of this invention to teach a system for creating a predetermined log of strapped variable height bundles, for use in the distribution of publications and the like, comprising at least one conveyor means on which to position a bundle of publications; measuring means for identifying that said bundle has reached a predetermined height; rotating means for tipping said bundles into a desired position and maintaining them in that position; strapping means for placing a strap around the entire log; labelling means for identifying said strapped log; and means for positioning said strapped log in the proper position on the pallet.

Further objects and features of this invention will become more apparent by reference to the following description taken in conjunction with the accompanying figure, in which:

FIG. 1 is a top plan view of the log creating section of the novel system;

FIG. 1*a* shows the computer-based control system for the log creating device of FIG. 1;

FIG. 4 is a side elevational view of an alternative embodiment of the log creating section of the novel system; and FIG. 5 is a perspective view of a completed pallet.

Figure 1:
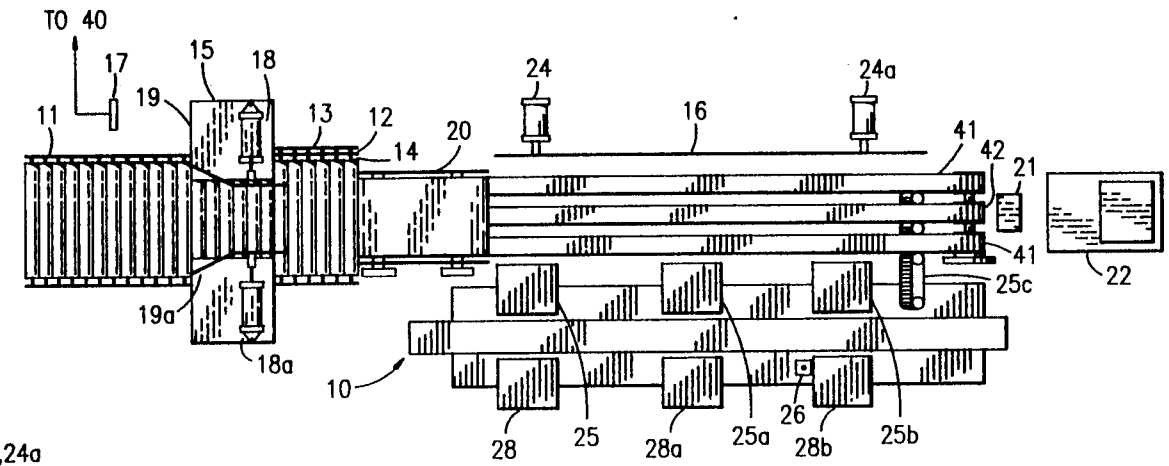
Figure 2:
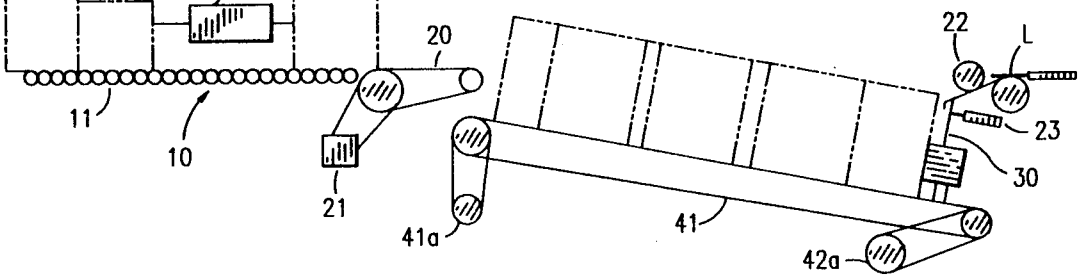
FIG. 2 is a side elevational view of the log creating section of the novel system.
Figure 2A:
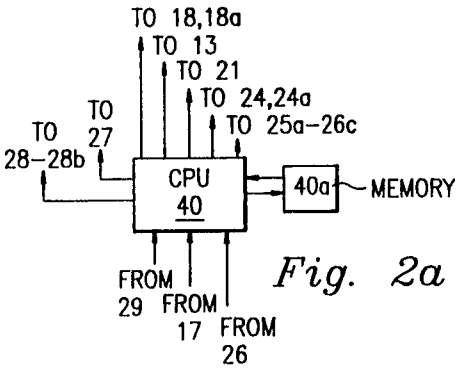

As shown in the figures, the novel system 10 receives bundles of publications from a standard bindery line by means of an infeed conveyor 11 which comprises a chain driven stationary roller conveyor that uses internal shafts 12 driven by a chain sprocket 13. The internal shaft 12 rotates through bushing 14 in a roller such that a soft drive is produced. This result allows the bundle to be transported along the conveyor 11 simply by friction. The pacer unit 15 provides the function of timing the bundle entry into the bundler 16. When the bundle is being ejected, the stacks cannot be fed into the bundler 16. Because of the soft drive, the incoming bundles can be stopped by the pacer 15. A sensor 17 senses an incoming bundle and cylinders 18 and 18*a* drive the stop plates 19 and 19*a* into the publications to hold them until the bundler is ready to accept more material.

The bundler nose belts 20 are driven by means of a motor 21 when the publications are fed into the bundler 16. The belts are pulsed on for a specific time to ensure that the bundle turns when it is dropped from the belt. The bundle drops off the belt causing it to rotate such that the top of the bundle is now in the vertical dimension within the log. A log height sensor 29 produces a variable output dependent upon bundle height and controls the motion of the bundle lowering based upon the height of the bundle. This control is necessary to ensure that the bundle will turn the correct amount to drop correctly on top of the log. It is also envisioned that the bundle height could be determined by means of the software, since the actual number of products per bundle is known. The bundle forming 41 and bundle stop 42 belts are lowered by motors 41*a* and 42*a* in accordance with the output of the sensor 29 thus lowering the log being formed before the bundle is dropped. The pins 43 coupled to stop belt 42 support the lower end of the log being formed. Once the log is of adequate size, the log is lowered to its completed full position.

While the log is being lowered, a label L is fed into the application tray 30, passing by a glue roller 22 and is then applied by cylinder 23 as the log reaches its full position. The pusher cylinders 24 and 24*a* then push the log onto the tier infeed belts 25, 25*a*, 25*b* and 25*c* until the photoelectric sensor 26 is actuated and the log is stopped and then strapped by the tier 27. After the strapping takes place, both the tier infeed belts 25 through 25*c* and the tier delivery belts 28, 28*a* and 28*b* are actuated and the log is delivered to a delivery conveyor (not shown), that is side sloping to place the log in a horizontal plane at the delivery point. The logs will then be moved to the pallet. The pallet label printer is a stand-alone unit in which a label is produced upon the predetermined number of logs which make up the complete pallet.

Shown in FIG. 4 is an alternative embodiment of the log creating section of the novel system. The section may be more viable in a fully automated palletizing system. Bundles (shown in dotted fashion) are entered on the infeed conveyor 11. The stop gate 31 is actuated stopping the bundles when the bundler actuates. The end board feeder/printer 32 is activated on the first bundle on an individual log. The bundles are then raised by lifter 33 into the log magazine 34. Bundle holding clips 38 retain the log within the magazine 34. A sensor 35 is activated upon the completion of a log and the log will then be pushed by the pusher 36 into the tying section 39, tied, and pushed into the delivery conveyor 37 upon the completion of the next log.

Figure 3:
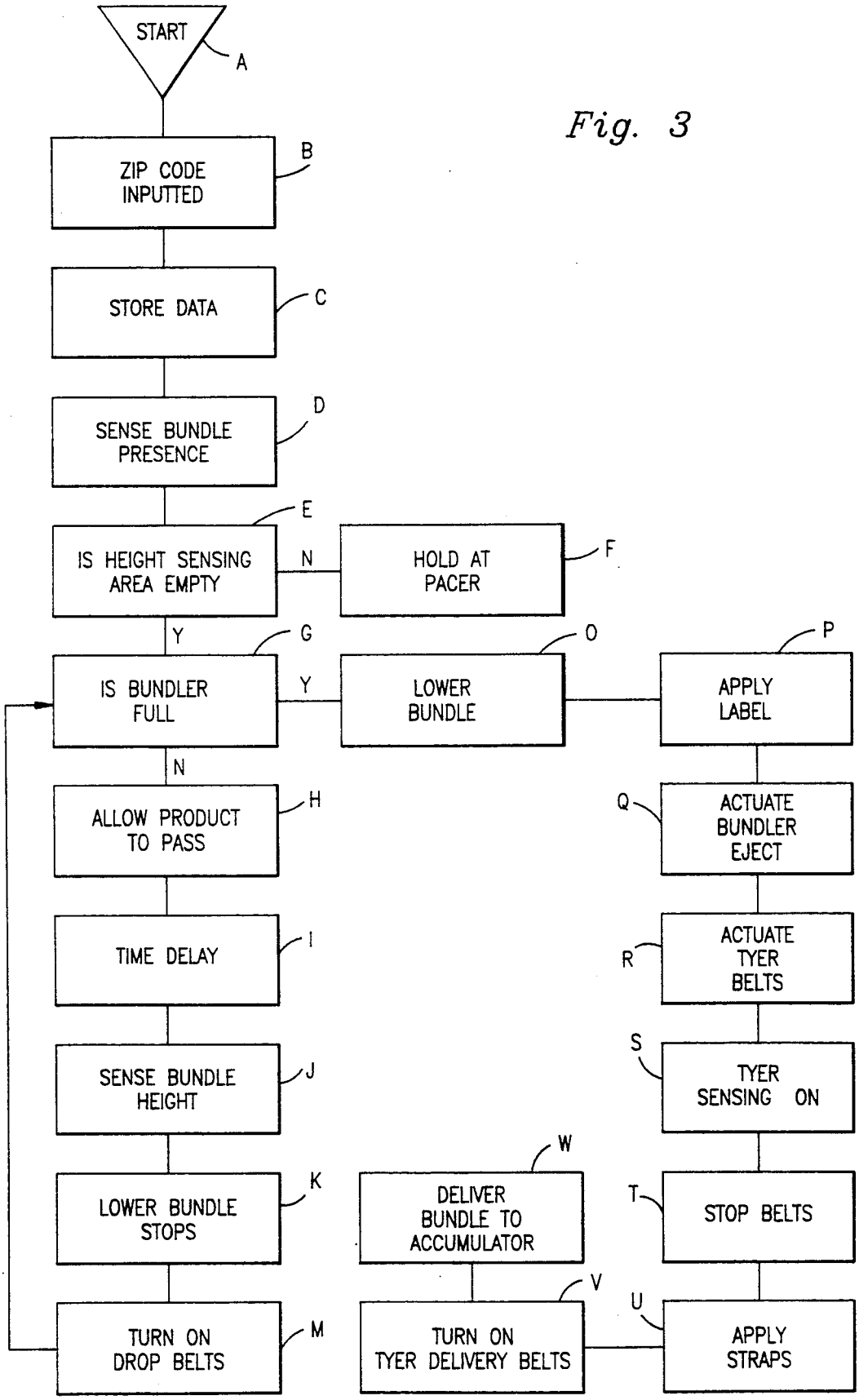
FIG. 3 is a flow chart of the control system of the novel system.

System control is a microprocessor based system 40 (see FIG. 1*a*) which when fed zip code or other data in memory 40*a*, will store the data until it is printed upon individual logs or the pallet. As shown in the flow diagram of FIG. 3, the data is sent from an existing system into the data memory (C). As the bundles of publications are sensed (D), the bundles are processed. If the log height sensing area is clear (E), the bundle is allowed to pass through the pacer. If the log height sensing area is full, the pacer is actuated and incoming bundles are stopped until the height sensing area is clear (F). The bundle that passes the pacer (H) causes the sensor to respond from its reference voltage (J). This change of voltage determines how far the bundle is lowered which corresponds to log size (K). The voltage returns to its reference voltage and starts a time delay (I) which holds the bundler belt on for a predetermined amount of time required for the log to complete the correct drop onto the bundle to create the log. This process is continued until the logger is full (G). A sensor mounted on the logger detects the teeth on the timing pulley, by knowing how many teeth have passed from the logger entry position. The system control distinguishes how far the logger is from being full. This value is then compared to the height of the incoming bundle of publications. If the incoming bundle of publications is larger than the remaining unused room in the log, the log is then set into its ejection cycle. The logger is lowered (O) into its full position; the label is applied (P); the pusher is fired (Q); the tier belts are turned on (R); the tier sensor is activated when the log is in the tying position (S). The tier belts are stopped (T) and the strapping is applied (U) and the log is delivered onto the delivery conveyor (V) and (W).

It can easily be seen that optional and alternative embodiments can be adapted to the system and method of operation. For instance, a diversion section can be added in the case two or three different zip code levels are being produced, specifically if 5, 7 and 9 zip code designations are being intermingled in the same production. It may be beneficial to have multiple logs for the different designations. It is obvious that the potential for remotely situated bundles being fed from multiple bindery machines may be effective. A quality control station may be provided for poor quality bundles that diverts those items from the flow. A quality control check point that compares the actual log to the data register for verification is also useful. A computer readable record of the actual pallet/log makeup may be supplied with the pallet to aid in the automatic breakdown of the pallet such as a diskette or tape.

While we have described our invention in connection with specific embodiments thereof, it is clearly to be understood that this is done only by way of example and not as a limitation to the scope of our invention as set forth in the objects thereof and in the appended claims.

We claim:

1. A method of creating a log of uniform width and breadth and of a substantially predetermined length, said log being formed from a multiple number of strapped bundles each containing a variable number of sequentially collected substantially flat items arranged in side-by-side fashion so that the width and breadth of the bundle becomes the width and breadth of the log and with the thickness of the bundle varying as a function of the number of items and the thickness of the items, said method including the steps of:

moving the bundles in sequence along a conveyor whereby the bundles are oriented on the conveyor so that the items in the bundles are substantially aligned one atop the other;

determining the thickness of each bundle as it is conveyed;

rotating each bundle at a turning location and moving the rotated bundle upon a surface of a bundle collection means whereby the items of the bundles delivered to the collection means are all arranged in side-by-side fashion along the collection means and the items are aligned transverse to the surface of the collection means;

measuring the length of the log being formed on the collection means;

determining by means of stored predetermined tolerances relating to the desired log length and the measured log length when the correct combination of bundles have been combined to complete a log;

tying together the bundles making up the completed log; and moving the tied log unit to a predetermined output location for subsequent delivery.

2. A method of creating a log of bundles, according to claim 1 further comprising the step of:

generating and supplying a computer readable record of the pallet contents to facilitate the distribution process of the items.

3. The method of claim 1 further comprising the steps of:

printing a label setting forth the contents of the log unit; and applying the printed label to the completed log.

4. The method of claim 1 further comprising the steps of:

placing a plurality of completed logs upon a pallet so that the longitudinal axes of the log units are substantially parallel, thereby forming a first layer of log units upon said pallet; and arranging a second layer of completed logs upon said first layer of completed logs so that the longitudinal axes of the completed logs of said second layer are substantially parallel to one another and are substantially perpendicular to the longitudinal axes of the completed logs in said first layer.

5. The method of claim 4 further comprising adding additional layers of completed logs using the criss-cross arrangement of logs employed in forming the first and second layers of completed logs on said pallet.

6. The method of claim 5 further comprising the steps of:

printing a label identifying the contents of said pallet; and applying said label to the completed pallet.

7. The method of claim 6 wherein the step of conveying bundles further comprises the step of:

diverting bundles from the collection means when a bundle is rejected;

storing information relating to such rejected bundles; and wherein printing a pallet load label further comprises identifying any bundle rejected from said pallet load.

8. The method of claim 1 further comprising the step of:

storing information relating to the items of each bundle being delivered to the conveying means for formation into logs;

said printing step further comprising the step of incorporating said stored information into the label applied to the log containing the bundle.

9. The method of claim 1 wherein the step of determining log length further comprises the step of restraining bundles on the conveyor upstream of those making up the log presently being completed on said collection means until said completed log is tied and moved to the output location.

10. The method of claim 1 wherein the step of moving the bundles and the collection means further comprises the step of moving an end stop along the collection means a spaced distance away from said turning location sufficient to receive the bundle and to prevent the bundle from further rotation.

11. The method of claim 1 wherein the step of determining the thickness of each bundle as it is conveyed further comprises the step of determining the thickness of the bundle when said bundle is created and storing the thickness information for subsequent use in forming a log.

12. A system for creating a uniform log of strapped bundles, for use in the distribution of publications and the like, comprising:

at least one conveyor means for receiving and conveying a bundle of publications;

said conveyor having a rotating base;

measuring means for identifying one dimension of said bundle;

tipping means for tipping bundles delivered to said tipping means by said conveyor into a desired position and maintaining the bundles in said desired position;

accumulating means for accumulating bundles tipped by said tipping means to form a log;

strapping means for placing a strap around the log;

labelling means for identifying said strapped log; and means for delivering said strapped log to a location for subsequent handling.

13. A system for creating a uniform log of strapped bundles, according to claim 12, wherein:

said measuring means comprises a variable output proximity sensor for determining the height of said incoming bundles; and moving the accumulating means to accommodate the bundle being delivered thereto.

14. A system for creating a uniform log of strapped bundles, according to claim 12, wherein:

said tipping means comprises a bundle belt acceleration system including means for moving the bundle to a desired position at a desired velocity and means to decelerate the bundle belt accumulation system to a stop allowing the bundle to continue, rotate and fall into position upon the accumulation means.

15. A system according to claim 12 wherein said accumulation means further comprises:

means for moving bundles delivered to said accumulation means toward a completed log position and away from said tipping means;

means for measuring the length of the log being formed by said bundles;

means for comparing the measured length with predetermined log length tolerance values; and means for energizing said strapping means when the length of the log being formed falls within said tolerance values and the next bundle to be delivered to the collection means has a height such that the bundle just measured, when added to the log being formed, will bring the resultant log length outside of said tolerance limits.

16. A system according to claim 15 wherein said accummulating means comprises a movable stop for supporting bundles accumulated by said accumulation means and means for moving the movable stop along the accumulating means to lower the accumulated bundles preparatory to receiving another bundle.

17. A system according to claim 16 wherein said log length measuring means comprises means responsive to movement of said stop means for measuring length.

18. A system according to claim 12 further comprising:

means for moving a completed log from said collection means to facilitate formation of a new log.

19. A method for forming a log of uniform along and breadth and of substantially predetermined length comprising the steps of:

(a) conveying a plurality of bundles along a predetermined path in a one-at-a-time fashion, each bundle being comprised of a variable number of sequentially collected items arranged side-by-side so that the items are aligned substantially horizontally;

(b) sequentially moving each bundle upon a platform;

(c) pushing the platform upwardly to move the bundle a predetermined distance above the original receiving position of the movable platform sufficient to receive a subsequent bundle;

(d) holding the bundle at the elevated position;

(e) lowering the movable platform to its start position for receipt of a subsequent bundle;

(f) repeating steps (b) through (e) until the bundles reach a predetermined height within a suitable tolerance range;

(g) pushing the completed log away from the log forming region to a tying region; and (h) tying the completed log.

20. The method of claim 19 further comprising the step of:

advancing the tied log from the tying region to an output location for subsequent handling.

* * * * *